US005853331A

United States Patent [19]

Ishikawa et al.

[11] Patent Number: 5,853,331

[45] Date of Patent: Dec. 29, 1998

[54] AMUSEMENT RIDE

[75] Inventors: Masami Ishikawa, Handa, Japan; Barton L. Merrell, Provo, Utah

[73] Assignee: Bungee Japan, Inc., Chita-gun, Japan

[21] Appl. No.: 73,475

[22] Filed: May 6, 1998

[51] Int. Cl.[6] ..... A63G 21/20

[52] U.S. Cl. ..... 472/88; 472/89; 104/69

[58] Field of Search ..... 472/88, 89, 49, 472/50, 130, 118, 90; 104/53, 69, 70, 77, 78

[56] References Cited

U.S. PATENT DOCUMENTS

| | | | |
|---|---|---|---|
| 535,938 | 3/1895 | Boyton | 104/70 |
| 1,008,518 | 11/1911 | Bailey | 104/53 |
| 3,861,318 | 1/1975 | Massa | 104/69 X |
| 4,285,514 | 8/1981 | Romero | 272/3 |
| 4,391,201 | 7/1983 | Bailey | 104/70 |
| 4,865,312 | 9/1989 | Katz | 272/56.5 |
| 5,246,401 | 9/1993 | Boatwright | 472/116 |
| 5,253,864 | 10/1993 | Heege | 472/88 |
| 5,318,481 | 6/1994 | St-Germain | 472/68 |
| 5,427,574 | 6/1995 | Donnelly-Weide | 472/116 |
| 5,649,866 | 7/1997 | Balwanz | 472/118 |
| 5,782,699 | 7/1998 | Harrap | 472/118 |
| 5,810,671 | 9/1998 | Balwanz et al. | 472/118 |

*Primary Examiner*—Kien T. Nguyen
*Attorney, Agent, or Firm*—Prince, Yeates & Geldzahler

[57] ABSTRACT

An amusement ride comprises a wheeled, multiple-seat cart or vehicle that is adapted to descend an inclined track having an upwardly curved launching portion, in a manner to launch the vehicle temporarily airborne in a trajectory similar to that of a ski jumper. The descent angle and upwardly curved launching portion of the track are very similar to a ski jump track. The vehicle is rollingly tethered to a pair of guy wires positioned on either side of the track and at a level relative to the track launch area to permit the vehicle to be launched temporarily airborne and fall freely without interference or restriction by the tethers. As gravity causes the vehicle to free fall, the tethers become taut with the guy wires, catch the vehicle in free-fall, and glide the vehicle along a predetermined descent down the guy wires toward twin laterally spaced poles or towers at the end of the ride, each pole or tower connected to a respective guy wire. The bottom towers are laterally spaced upon either side of the line of descent and trajectory of the wheeled vehicle a distance that is considerably greater than the width of the launching tower. As the rolling tethers approach the laterally spaced lower towers along respective tether support cables, separation of the tethers at their points of contact with the guy wires tend to raise the vehicle against its own gravity weight, thereby causing its own gravity weight to brake the vehicle in its descent down the guy wires.

14 Claims, 12 Drawing Sheets

AMUSEMENT RIDE

BACKGROUND OF THE INVENTION

1. Field of the Invention

The present invention relates to amusement rides, and more particularly relates to an amusement ride wherein the rider is strapped inside a wheeled vehicle that is gravity-propelled down an inclined track or ramp and is launched from the track or ramp momentarily airborne in a trajectory similar to that of a ski jumper.

2. Description of the Prior Art

Amusement rides abound. However, no amusement ride exists for launching a rider airborne in a trajectory similar to that of a ski jumper, wherein the rider's vehicle is tethered to a support cable that serves a dual function of: (1) the safety mechanism for the rider's vehicle to gradually ease the vehicle from an airborne state to a tethered state for preventing the rider from sudden impact upon surface landing; and (2) providing the braking mechanism for gradually braking the descent of the rider's vehicle as the vehicle nears the end of the ride. For instance, U.S. Pat. No. 5,253,864 shows an amusement ride comprising a wheeled boat that rolls down an inclined ramp and splashes into a water tank. The boat is airborne momentarily, but has neither safety means nor means for softening the impact of the surface landing, nor braking means. Likewise, U.S. Pat. No. 4,391,201 shows a similar amusement ride wherein a toboggan slides down a ramp and is momentarily airborne prior to a water landing. Again, the rider vehicle has neither a safety tether nor means for lessening the surface impact.

Amusement parks are replete with rides that tether the rider to a rotating or reciprocally swinging device. None of these tether-type rides permits momentary airborne free flight in a trajectory similar to that of a ski jumper. The closest prior art is shown in U.S. Pat. No. 5,318,481, wherein a rider is suspended by a tether over a large up-draft propeller. The up-draft wind flow is designed to levitate the rider for purposes of both an amusement ride and for facilitating sky diving practice. This device, however, does not launch the rider momentarily airborne.

OBJECT OF THE INVENTION

It is therefore an objection of the present invention to provide an amusement ride wherein the rider is launched momentarily airborne in a trajectory similar to that of a ski jumper.

It is a further object of the present invention to provide such an amusement ride wherein the rider or rider vehicle is tethered to a safety wire or cable that permits momentary airborne free fall following the launch.

It is a further object of the present invention to provide such an amusement ride that safety-tethers the rider or vehicle to the safety wire or cable in a manner to permit the rider or vehicle to descend the amusement ride ramp and be launched momentarily airborne that permits a momentary airborne and free fall ride, prior to being caught by a safety cable.

It is still a further object of the present invention to provide such an amusement ride wherein the braking mechanism is gradual to thereby gradually reduce the speed of the rider following free fall and eliminate or minimize sudden impact at the end of the ride.

SUMMARY OF THE INVENTION

The amusement ride takes the form of a wheeled, multiple-seat cart or vehicle that is adapted to descend an inclined track having an upwardly curved launching portion, in order to launch the vehicle temporarily airborne in a trajectory not unlike that of a ski jumper. In fact, the descent angle and upwardly curved launching portion of the track are very similar to a ski jump track.

The vehicle is tethered to a pair of guy wires positioned on either side of the track and at a level relative to the track launch area to permit the vehicle to be launched temporarily airborne and fall freely without interference or restriction by the tethers. As gravity causes the vehicle to free fall, the tethers become taut with the guy wires, thereby preventing the vehicle from free falling a very large distance, and preventing the vehicle from an impact landing on the ground below.

The guy wires are angled downwardly from a first support tower in the direction of travel of the vehicle, in order to permit the vehicle to glide, tethered, downwardly along the guy wires toward twin laterally spaced poles or towers at the end of the ride, each pole or tower connected to a respective guy wire. In this manner, the vehicle is permitted to descend gradually under its own weight toward the bottom towers.

The bottom towers are laterally spaced upon either side of the line of descent and trajectory of the wheeled vehicle a distance that is considerably greater than the width of the launching tower. In this manner, as the tethers approach the laterally spaced lower towers along respective tether support cables, separation of the tethers at their points of contact with the guy wires tend to raise the vehicle against its own gravity weight, thereby causing its own gravity weight to brake the vehicle in its descent down the guy wires.

DETAILED DESCRIPTION OF THE INVENTION

Figure 1:
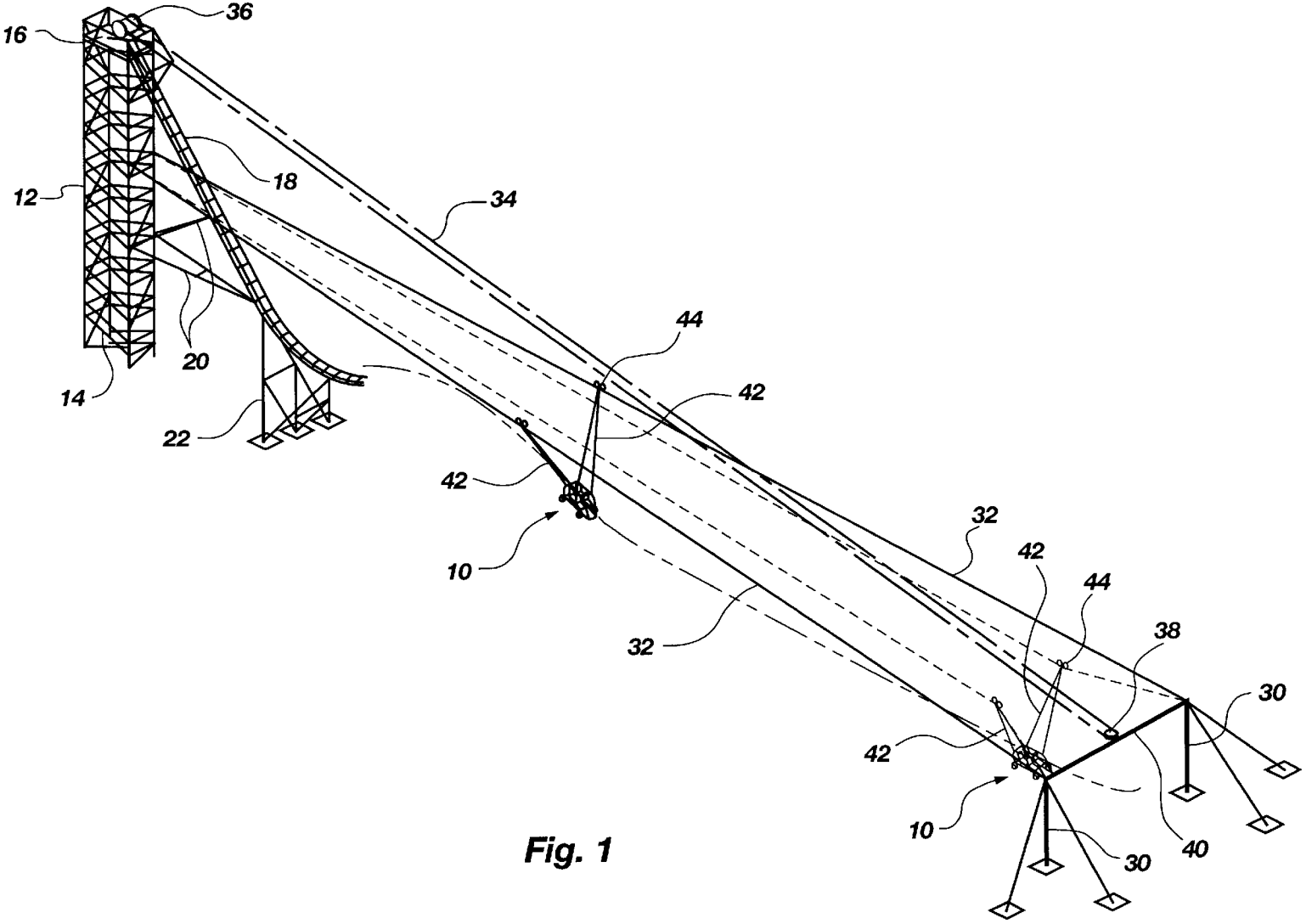
FIG. 1 is a perspective view of the amusement ride of the present invention.

Turning now to the drawings, and initially to FIG. 1, the amusement park ride of the present invention is shown in perspective view. The amusement ride vehicle is shown generally illustrated by the numeral 10. The vehicle 10 will be described in greater detail hereinbelow with reference to FIGS. 6 and 7.

The amusement ride of the present invention comprises a first vertical tower 12 having a stairway 14 from bottom to top that leads up to a landing or platform 16 where the riders board the vehicle 10, and from where the vehicle is released to descend the track 18.

As can be appreciated, the track 18 is supported by a plurality of braces 20 extending between the track and the tower 12, and a plurality of ground braces 22 extending from the ground upwardly in a manner to support the track a specified distance or height from the ground level.

Figure 2:
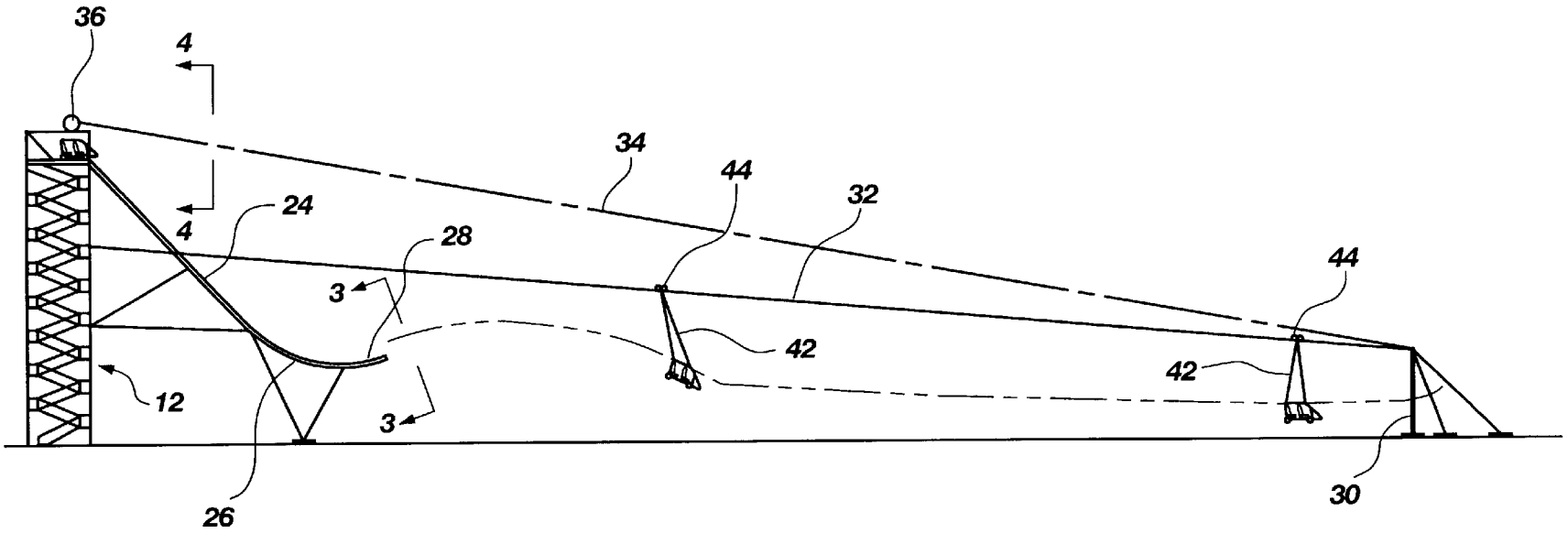
FIG. 2 is a side view of the amusement ride of the present invention, illustrating the concept thereof.

As best shown in FIG. 2, the track 10 is of the general configuration of a ski jump, having an essentially straight section 24 that is inclined downwardly at an angle of approximately 40° from vertical. In the preferred embodiment, following a vertical drop of approximately 50 feet, the track 18 transitions into a gradual upward curve 26, terminating in a launching section 28 at the end of the track that is directed slightly upwardly in a manner to launch the wheeled vehicle temporarily airborne in a slightly upward direction.

FIGS. 1 and 2 also illustrate a pair of laterally spaced support towers 30 positioned a horizontal distance of approximately 350 feet from the first vertical tower 12 in the direction of the track 18 and intended airborne trajectory of the wheeled vehicle. The purpose of the lateral spacing of the support towers 30 will be explained in greater detail hereinbelow.

The first vertical tower 12 and the respective laterally spaced support towers 30 are inter-connected by plurality of cables as shown in FIGS. 1 and 2. Specifically, a pair of tether support cables 32 are connected to respective tops of the lateral support towers 30 at first ends thereof, and to the vertical tower 12 at the other ends thereof at locations on respective sides of the tower and approximately two-thirds the distance up the tower from the bottom.

A vehicle retrieval cable 34 is attached to a winch mechanism 36 located at the top of the vertical tower 12, and to an idler pulley 38 positioned at the mid-point of a cross-member 40 connecting the respective tops of the laterally support towers 30. In this manner, the vehicle retrieval cable 34 is in a vertical plane of the track 18 and intended trajectory of the wheeled vehicle 10.

FIGS. 1 and 2 also illustrate the pairs of sets of vehicle tethers 42 that attached the vehicle to respecive tether support cables 32. Those skilled in the art will appreciate that the pluralities of sets of vehicle tethers 42 are attached to the vehicle along portions of the overhead frame of the vehicle in order that the center of gravity of the vehicle will be well below the tether attachment points in order to maintain automatic stabilization of the vehicle at the end of its free-fall as the vehicle tethers 42 become taut as the tethers 42 "catch" the vehicle from free-fall.

The upper ends of the tethers 42 are slidably or rollingly attached to respective tether support cables 32 by pulley mechanisms 44 in a manner that the vehicle tethers 42 freely slide or roll along respective tether support cables 32 as the vehicle is descending the track and in its momentary free-fall. Following free-fall of the vehicle, the pulley mechanisms 44 permit the taut vehicle tethers 42 to "roll" down the respective support cables 32 with very little or no frictional resistance therebetween.

Figure 3:
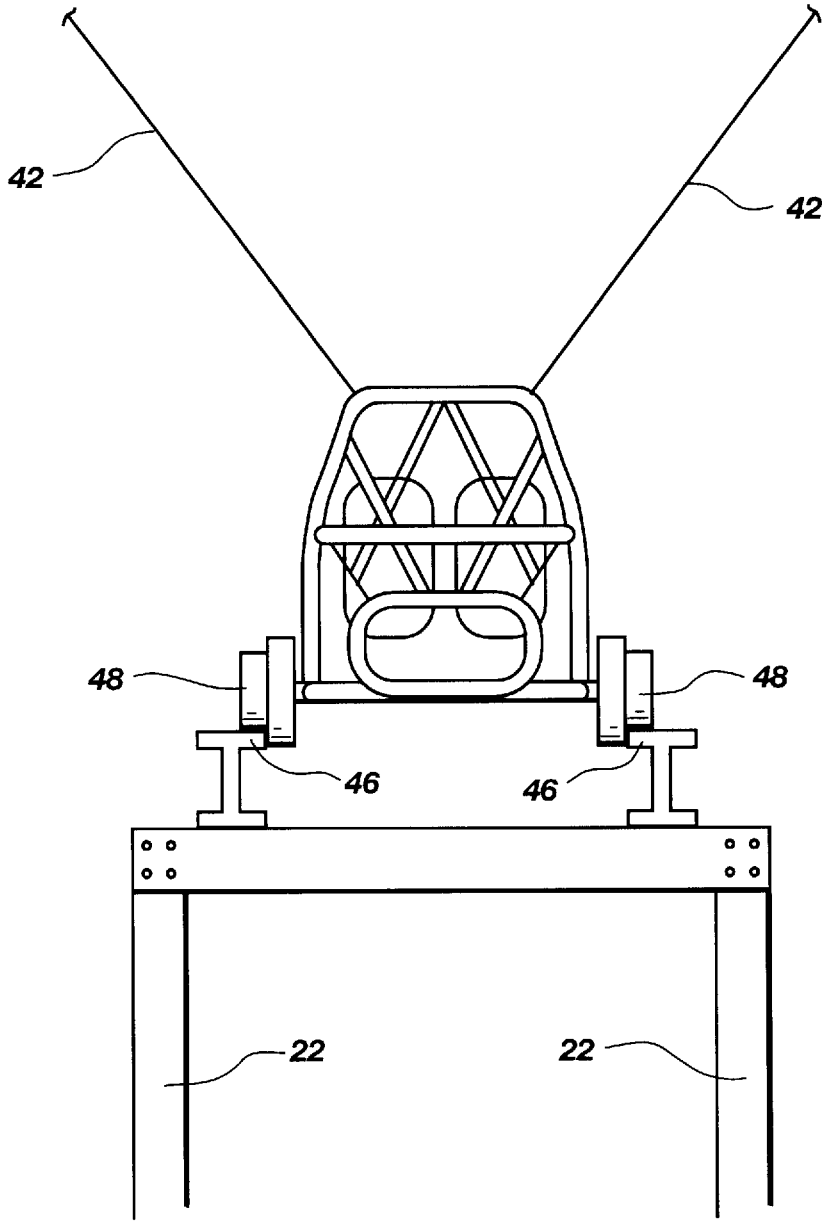
FIG. 3 is a view taken in the direction of arrows 3—3 in FIG. 2, illustrating the vehicle near the end of the track as it leaves the track into an airborne trajectory.

FIG. 3 illustrates the amusement ride vehicle 10 near the end of the track 18 as the vehicle is about to leave the track into an airborne trajectory. FIG. 3 illustrates that the track 18 comprises a pair of laterally spaced track rails 46 that cooperate with dual-diameter steel rail wheels 48 to retain the vehicle 10 in position between the track rails, and direct the vehicle into its correct intended trajectory upon launch. The track rails 46 comprise the track 18, and are supported thereon in a customary manner.

Figure 4:
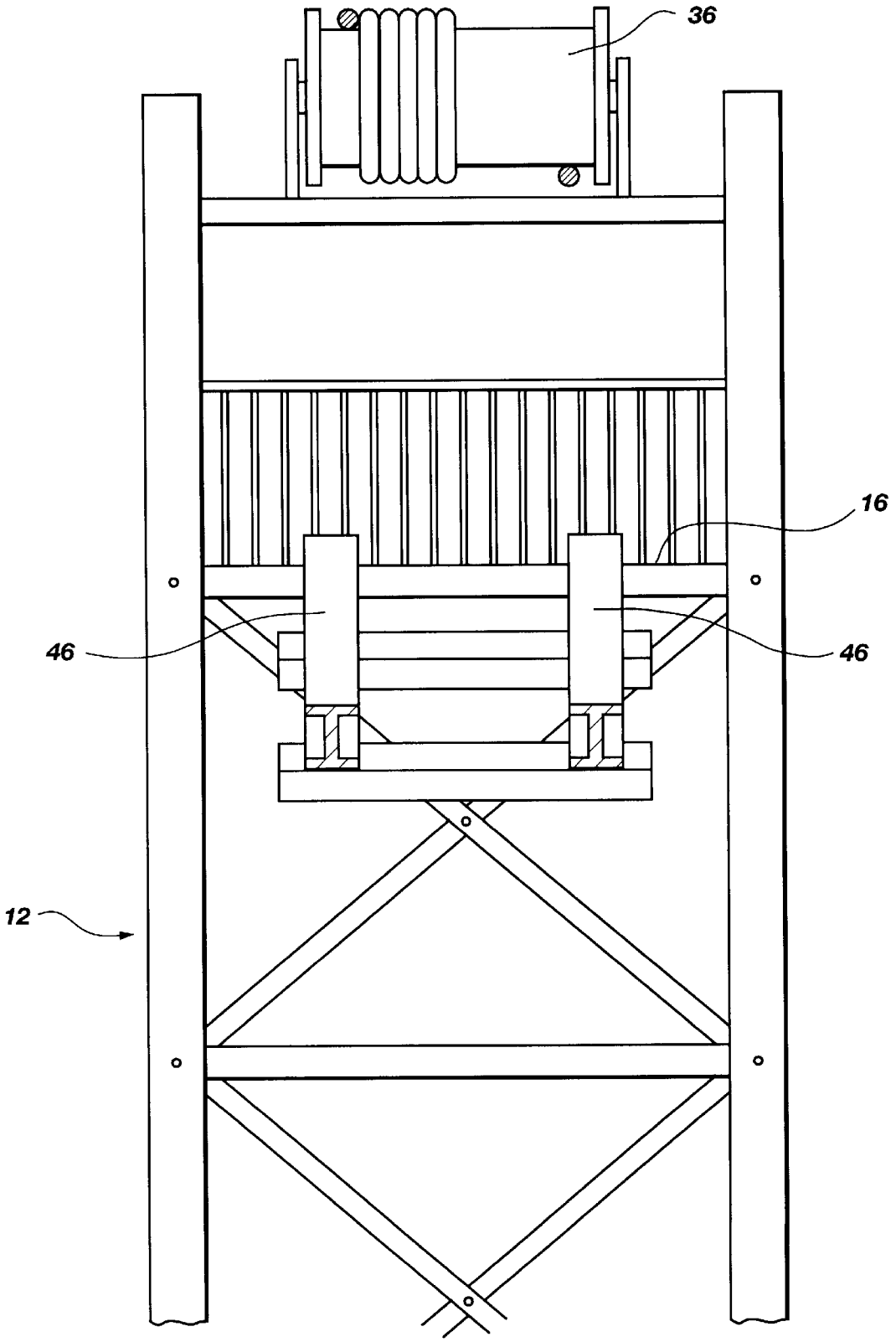
FIG. 4 is a view taken in the direction of arrows 4—4 in FIG. 2, illustrating the rail and track system of the present invention.

FIG. 4 is a view of the loading platform 16 at the top of the vertical tower 12, and also illustrates the dual parallel rails 46 that comprise the vehicle track 18.

Figure 5:
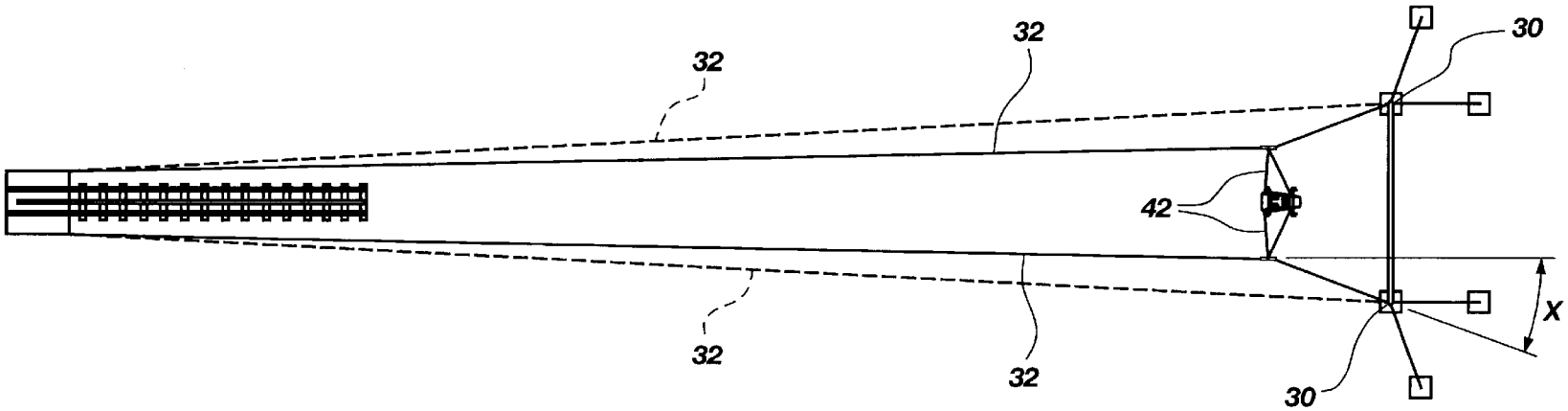
FIG. 5 is a top view illustrating the connection of the guy wires to the lower towers, and specifically illustrating the braking mechanism.

FIG. 5 is a top view of the amusement ride of the present invention that illustrates the braking mechanism for the vehicle as it nears the end of its run along the tether support cables 32. As can be appreciated, as the vehicle is descending the track 18, and while it is airborne momentarily following its launch from the track, the tether support cables 32 hang in essentially a straight line (i.e., in a vertical plane) between their respective connection points at respective sides of the vertical tower 12 and the respective laterally spaced support towers 30, as shown by the broken lines 32 in FIG. 5. However, once the vehicle drops in free-fall a specified vertical distance, the vehicle tethers 42 become taut as the weight of the vehicle pulls the tethers down from the tether support cables 32. As this happens, the tether support cables 32 are pulled slightly inwardly toward the plane of the track 18 and trajectory of the vehicle by the force of the weight of the vehicle acting essentially in the plane. This inward force tends to pull the tether support cables 32 inwardly, as shown in FIG. 5. Those skilled in the art will appreciate the closer the vehicle 10 gets to the ends of the tether support cables, the greater the angle "X" between that portion of the tether support cables 32 and its original line becomes. The greater this angle "X", the more stopping resistance is applied to the vehicle via the vehicle tethers 42 and pulley mechanisms 44. In this manner, the "braking" of the vehicle as it approaches the end of the ride increases essentially exponentially with the vehicle's proximity to the ends of the tether support cables 32.

Figure 6:
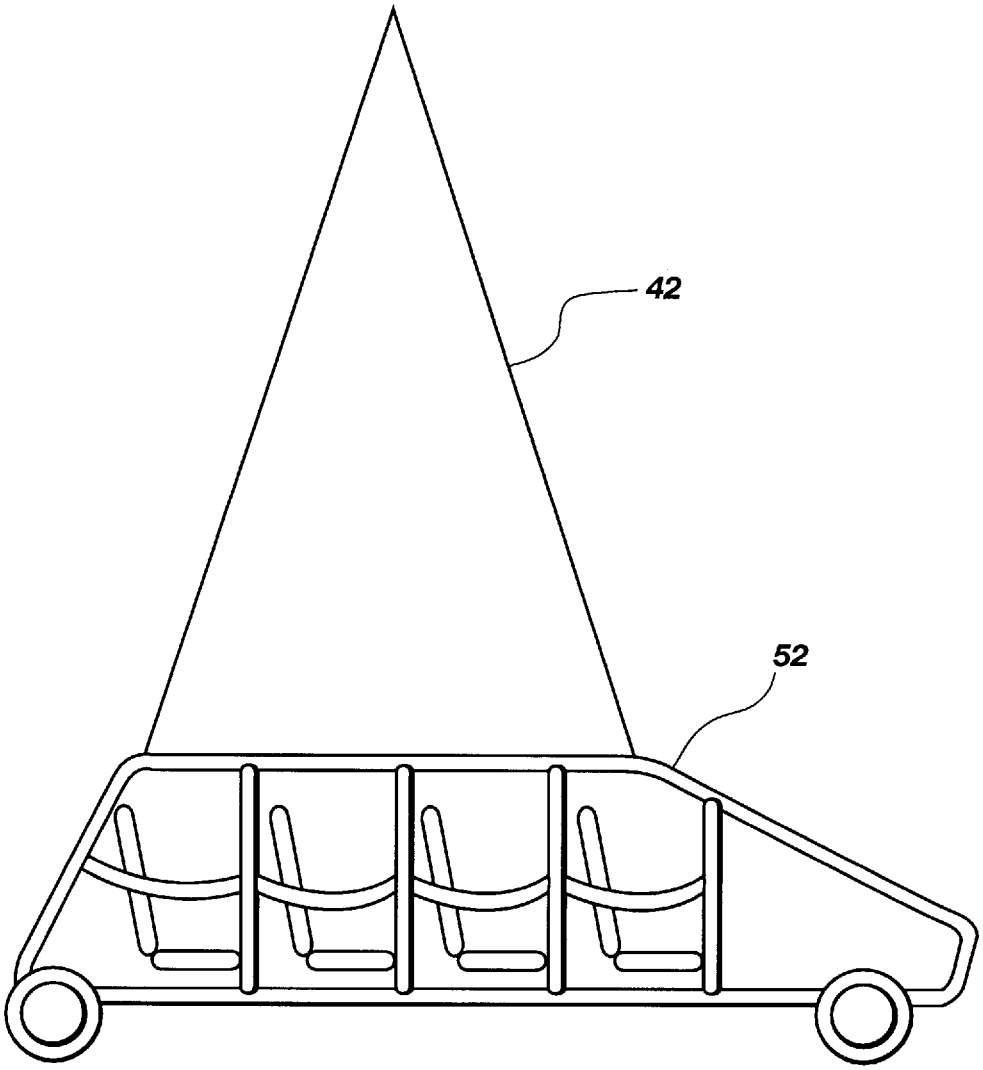
FIG. 6 is a side view of an amusement ride vehicle used herewith.

FIG. 6 illustrates a preferred embodiment of the amusement vehicle ride 10 of the present invention. This preferred embodiment accommodates four riders, one abreast in a single line. As shown, the vehicle 10 comprises a cylindrical pipe or rod frame 52 that totally encloses the individual riders within the vehicle. As previously indicated, the vehicle tethers 42 attach to top portions of the vehicle frame 52 above the center of gravity of the vehicle in order to maintain the vehicle in a stable position when supported by the vehicle tethers 42 and tether support cables 32.

Figure 7:
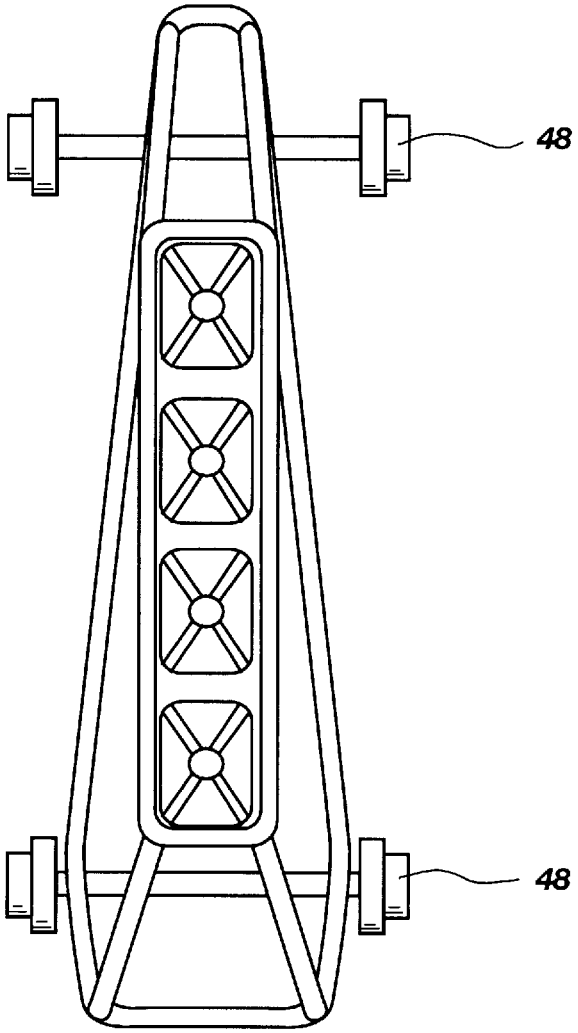
FIG. 7 is a top view of the amusement ride vehicle shown in FIG. 6.

FIG. 7 is a top view of the preferred embodiment of the vehicle 10, again illustrating the single line rider seating arrangement. In addition, FIG. 7 illustrates the lateral spacing or "track" of the dual diameter steel rail wheels 48, this relatively wide wheel track functioning to stabilize the vehicle as it descends the track 18 and is launched from the track launching section 28.

Figure 8:
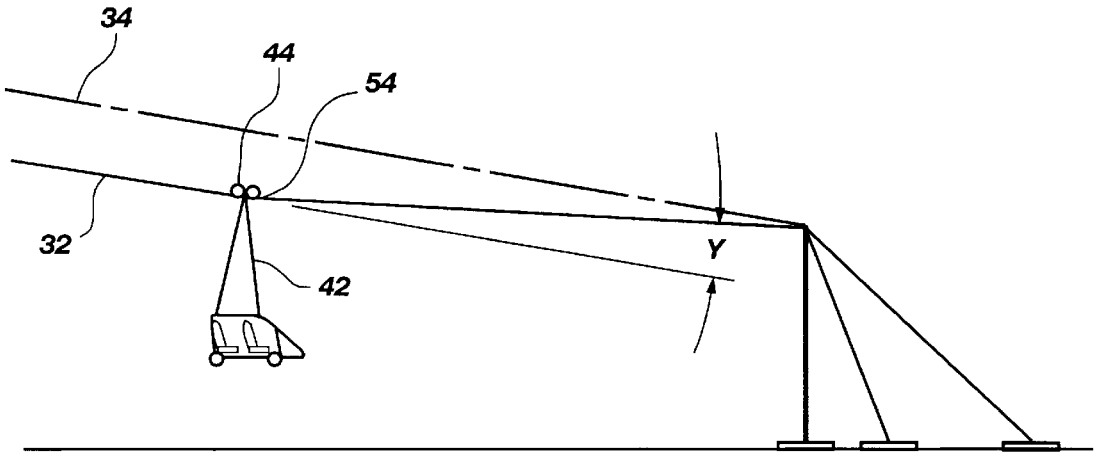
FIG. 8 is a partial side view of the lower portion of the amusement park ride, illustrating the vehicle as it approaches the breaking mechanism and the end of the ride.

FIG. 8 is a side view of the lower portion of the amusement park ride illustrating the vehicle as it approaches the braking mechanism and the end of the ride. As can be appreciated, once the vehicle tethers 42 are taut, the vehicle continues its forward and backward oscillation from the point of contact 54 of the vehicle tether pulley mechanism 44 with the respective tether support cables 32. Also, of course, the tether support cables 32 are made taut by the weight of the vehicle 10, the tether support cables 32 defining a slight angle "Y" relative to each other about the point of contact of the tether pulley mechanism with the tether support cables. As can be appreciated, this angle "Y" increases dramatically as the vehicle and pulley mechanism 44 approach the respective ends of the tether support cables 32 at the laterally spaced support towers 30.

Figure 9:
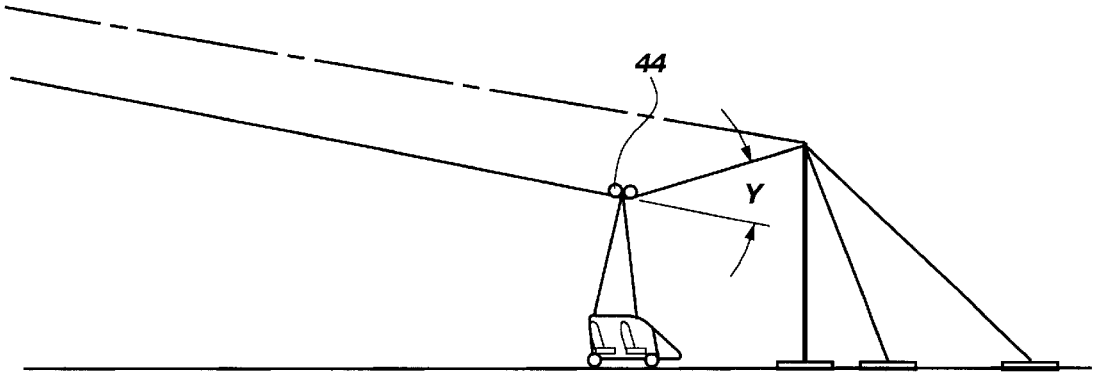
FIG. 9 is a partial side view of the lower portion of the amusement park ride, illustrating the vehicle during the braking function.

FIG. 9 is a partial side view similar to FIG. 8, illustrating the amusement ride vehicle in severe braking function. Specifically, the weight of the vehicle 10 has increased the angle "Y" between the sections of respective tether support cables 32 to the point that further "downward" movement of the vehicle (to the right in FIG. 9) actually results in a tendency of the vehicle pulley mechanism 44 to ride in an upward direction along the tether support cables 32 toward the top end of the respective laterally spaced support towers, against the action of the force of gravity pulling the vehicle downwardly. This is also shown in FIG. 5, wherein the vehicle tethers 42 are tending to pull the tether support cables 32 inwardly toward the plane of travel of the vehicle, against the force of momentum of the vehicle, and specifically the respective pulley mechanisms 44, tending to "spread" the pulley mechanisms toward the respective laterally spaced support towers 30. Those skilled in the art will appreciate that the result of this action, also, is to attempt to raise the amusement ride vehicle against the force of its own weight, the result being a gradual, but rapid, braking effect applied directly to the pulley mechanism 44, and indirectly to the amusement ride vehicle. Finally, as shown in FIG. 9, the amusement ride vehicle comes to rest at a point a prescribed distance from the laterally spaced support towers, and at a prescribed height or distance from the ground landing.

Figure 10:
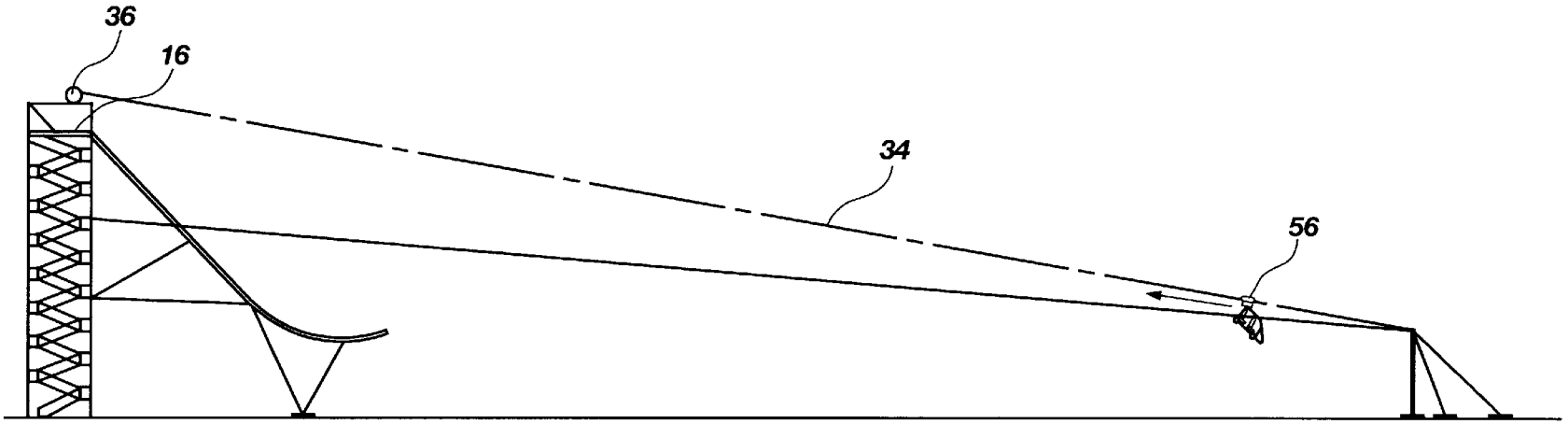
FIG. 10 is a side view similar to FIG. 2, illustrating the return of the vehicle to its starting point.

FIG. 10 is a side view similar to FIG. 2 that illustrates the retrieval of the amusement ride vehicle from its "landing" or "resting" position shown in FIG. 9 to the start of its run on the platform 16 atop the first vertical tower 12. The retrieval mechanism as shown in FIG. 10 comprises the vehicle retrieval cable 34 and winch mechanism 36 located at the top of the vertical tower 12. The vehicle retrieval cable 34 contains a hoist 56 for hooking onto the amusement ride vehicle, preferably at the rear of the vehicle, and hoisting the vehicle upwardly from its resting position shown in FIG. 9 up to the pulley mechanism 44. With the vehicle hoisted up to the retrieval cable 34, the tower winch mechanism 36 transports the vehicle back up to the vertical tower platform 16. This tower winch mechanism and vehicle retrieval cable are similar to corresponding winch mechanisms and cables used in conventional ski lifts. As appreciated, as the vehicle approaches the tower platform, the operators atop the tower can simply align the vehicle front wheels with the track rails, thereafter lowering the rear portion of the vehicle down securely on the track rails in position for the next set of riders.

Figure 11:
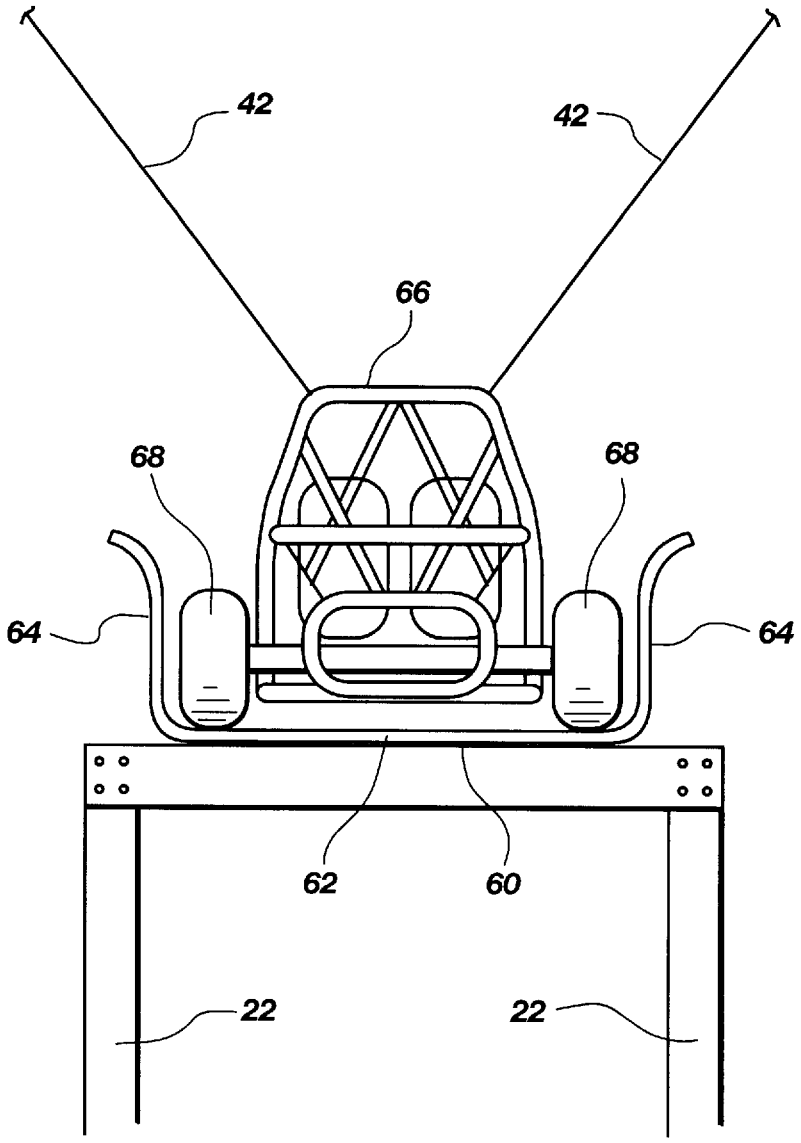
FIG. 11 is a view similar to FIG. 3, illustrating an alternative embodiment of the vehicle.

FIG. 11 is a view similar to FIG. 3 illustrating an alternative embodiment of the amusement ride vehicle and track of the amusement ride of the present invention. Specifically, in this FIG. 11 embodiment, the track rails are replaced with a closed wall chute 60 comprising a flat bottom wall 62 and laterally spaced vertical side walls 64. This closed wall chute 60 is constructed of a plastic or fibreglass material and has an essentially smooth inner surface of the flat bottom wall and vertical side walls. The vehicle in this FIG. 11 embodiment is similar to the FIG. 3 embodiment vehicle, in that it comprises a cylindrical type or rod frame 66 that also totally encloses the individual riders within the vehicle. This embodiment, however, has the four riders positioned two abreast, as opposed to one abreast in a single line as in the FIG. 5 embodiment. In this manner, the vehicle has a much wider "track" and is therefore more stable.

Figure 12:
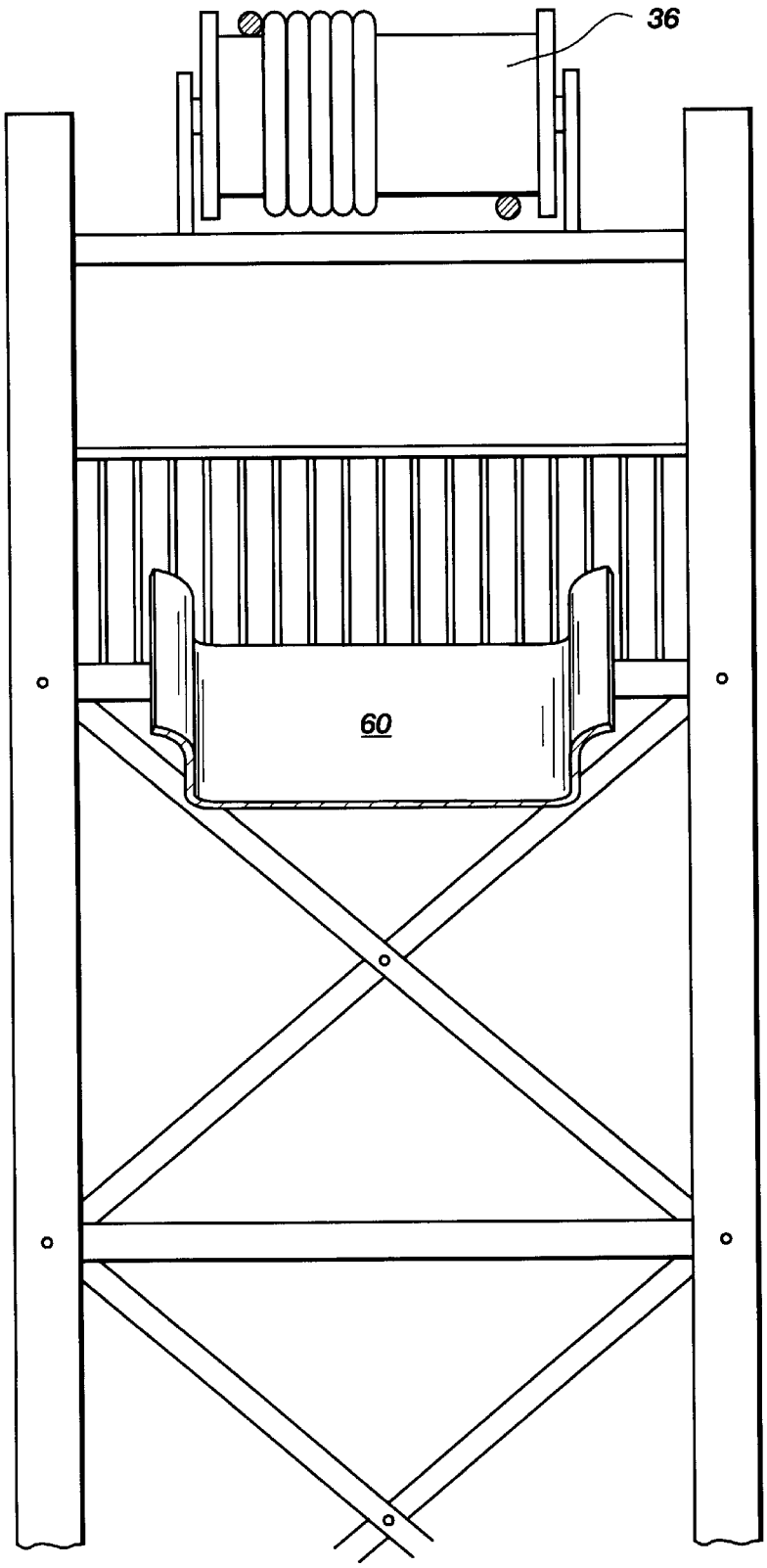
FIG. 12 is a view similar to FIG. 4, illustrating the rubber wheel and chute system of the alternative embodiment.

The FIG. 12 embodiment vehicle also is fitted with plastic, rubber, or pneumatic wheels and tires 68, as opposed to the dual diameter steel rail wheels of the FIG. 6 embodiment. Due to the different types of wheels and tires, this embodiment is somewhat lighter in weight and has a higher center of gravity than the FIG. 6 embodiment having the dual diameter steel rail wheels. Therefore, the wider "track" functions to maintain the stability of this FIG. 11 embodiment vehicle, notwithstanding the fact that it has a higher center of gravity.

The closed wall chute 60 can be fabricated in a manner similar to that of a water slide chute, and specifically can be constructed of a plurality of interlocking chute sections that define the straight portion, curved portion, and launching portion of the chute.

FIG. 12 is a view similar to FIG. 4 that better illustrates the design of the closed wall chute 60. FIG. 12 also illustrates the tower winch mechanism 36 used to retrieve the amusement ride vehicle from its stopping position shown in FIG. 9 back to the tower platform 16.

Figure 13:
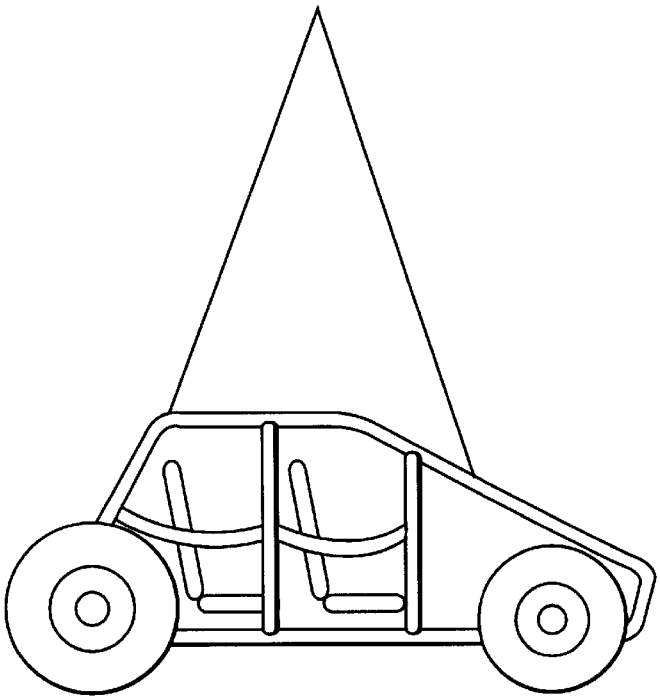
FIG. 13 is a side view of the alternative embodiment of the amusement ride vehicle used herewith.
Figure 14:
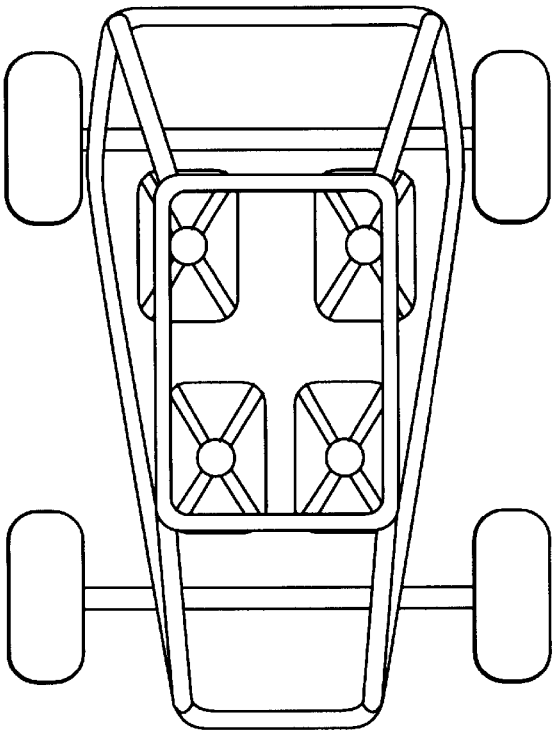
FIG. 14 is a top view of the alternative embodiment of the amusement ride vehicle shown in FIG. 13.

FIGS. 13 and 14 better illustrate the alternative embodiment of the amusement ride vehicle. As shown, this embodiment is wider and shorter than the previous embodiment vehicle, the increased width and "track" of the rubber or pneumatic wheels and tires having been previously explained. Those skilled in the art will readily appreciate, also, that the second moment of inertia about a transverse axis through the center of gravity of the amusement ride vehicle is considerably less than the corresponding moment of inertia of the FIG. 5 vehicle. This results in a vehicle ride that is more "active" from the standpoint of its oscillating within the vertical plane of its trajectory about the lateral axis essentially through its center of gravity. In other words, the oscillations of this embodiment vehicle during its free-fall trajectory are faster and greater in magnitude than the oscillations of the previous embodiment vehicle in free-fall, due to its lower second moment of inertia, which is due to its shorter length, as compared to the FIG. 5 embodiment.

OPERATION

Referring again to FIGS. 1 and 2, after climbing the stairway 14, one to four riders board an amusement ride vehicle positioned at the top of the vertical tower. When the riders are strapped in, a conventional braking mechanism releases the vehicle to begin its descent down the straight part 24 of the track, whereupon it reaches its maximum speed of approximately 40 miles per hour. At this point, the two sets of vehicle tethers 42 are loose, and are bowed outwardly from the vehicle on each side.

As the vehicle is launched from the launching section 28 of the track, it is momentarily airborne in a trajectory similar to that of a ski jumper. The vehicle will inherently oscillate slightly during its free-fall within the vertical plane of its trajectory about an axis through the center of gravity of the vehicle and normal to the plane of its trajectory. At this point, also, riders can enhance this inherent oscillation by collectively shifting their weight back and forth while seated in the vehicle.

Depending on the weight distribution in the vehicle, it may tend to nose up, nose down, or remain relatively level during its momentary free flight. However, under the force of gravity, the vehicle soon drops to the point of extending the vehicle tethers 42 taut against the tether support cables 32. Inasmuch as the tether support cables 32 are normally not taut, but rather do incorporate a pre-determined amount of slack, as the weight of the vehicle pulls the tether support cables downwardly, the force provided by the tether support cables that opposes the force of gravity and inertia of the vehicle is applied to the vehicle in a gradual manner, initially tightening up the tether support cables 32 at their approximate mid-points, as shown in FIG. 8. From the FIG. 8 position, the amusement ride vehicle continues to oscillate about the pulley mechanisms 44 as the pulley mechanisms roll down respective tether support cables 32. Because of the fact that the point of oscillation, at 44, is now much more remote from the center of gravity, and because of the fact that the tether support cables 32 are now pulling the vehicle tethers 42 laterally apart, as the pulley mechanisms 44 approach the respective laterally spaced support towers, this vehicle oscillation is quickly dampened. In addition, as the pulley mechanisms 44 approach the laterally spaced support towers, and the vehicle tethers are progressively separated, as shown in FIG. 5, the effect of this movement is to progressively raise the vehicle, resulting in a near level and horizontal path for the amusement ride vehicle as it approaches the end of its run. Most importantly, the upward force of the tether support cables acting against the force of gravity of the vehicle imparts a gradual but rapidly increasing braking force to the movement of the respective pulley mechanisms 44 along respective tether support cables, and therefore indirectly to the amusement ride vehicle as it nears the end of its run. The spacing of the laterally spaced support towers is designed such that the vehicle is brought to rest at a pre-determined spot, of course, prior to the pulley mechanisms 44 reaching the ends of the tether support cables and support towers.

At this point, the riders deboard the vehicle, and exit the amusement ride area in a conventional manner. Operators then lower a hook from the hoist mechanism 56, hook it onto a ring on the back of the vehicle, and hoist the vehicle upwardly toward the pulley mechanism. When the vehicle is hoisted up against the pulley mechanism, the tower winch mechanism on the tower then pulls the vehicle upward to the tower (to the left in the figures), as shown in FIG. 10. As the vehicle reaches the vertical tower platform 16, operators align the front wheels of the vehicle with the track rails, and then lower the rear part of the vehicle down on the track rails. Following unhooking of the vehicle from the hoist mechanism 56, and raising the winch hook out of the way, the vehicle is now prepared for a subsequent rider loading and ride down the track.

What is claimed is:

1. An amusement ride comprising:

a pair of guy wires, each guy wire having a first end a second end;

first support means for supporting the first end of each guy wire;

second support means for supporting the second end of each guy wire, the second support means being lower in elevation than the first support means;

a track having a first generally downwardly inclined section connected at one end to the first support means, and the opposite being end free, the track directed generally towards the second support means;

a wheeled vehicle adapted to carry a rider and descend the track and be launched airborne by and from the track at a location adjacent the track free end; and a pair of safety wires, each safety wire connected to the vehicle at first ends thereof, and connected to respective guy wires at second ends thereof in a manner to freely move along respective guy wires.

2. An amusement ride as set forth in claim 1, wherein the track includes a slightly upwardly directed launching section adjacent the free end.

3. An amusement ride as set forth in claim 1, wherein the track comprises a set of parallel rails.

4. An amusement ride as set forth in claim 1, wherein the track comprises a trough-like chute having sidewalls.

5. An amusement ride as set forth in claim 1, wherein the first ends of the safety wires are connected to respective sides of the vehicle.

6. An amusement ride as set forth in claim 1, wherein the guy wires are connected to the second support means at a greater lateral distance than the lateral distance at which the guy wires are connected to the first support means.

7. An amusement ride comprising:

a first tower having an upper end;

second tower means having an upper end that is lower in elevation than the first tower upper end;

a track having a first generally downwardly inclined section connected at one end to the first tower adjacent its upper end, and the opposite end being free, the track directed generally towards the second tower means;

a pair of guy wires, each guy wire having a first end connected to the first tower adjacent its upper end, and each having a second end connected to the second tower means adjacent its upper end;

a wheeled vehicle adapted to carry a rider and descend the track and be launched airborne by and from the track at a location adjacent the track free end; and a pair of safety wires, each safety wire connected to the vehicle at first ends thereof, and connected to respective guy wires at second ends thereof in a manner to freely move along respective guy wires.

8. An amusement ride as set forth in claim 7, wherein the first tower is taller than the second tower means.

9. An amusement ride as set forth in claim 7, wherein the track includes a slightly upwardly directed launching section adjacent the free end.

10. An amusement ride as set forth in claim 7, wherein the track comprises a set of parallel rails.

11. An amusement ride as set forth in claim 7, wherein the track comprises a trough-like chute having sidewalls.

12. An amusement ride as set forth in claim 7, wherein the first ends of the safety wires are connected to respective sides of the vehicle.

13. An amusement ride as set forth in claim 7, wherein the second tower means comprises two separate spaced apart towers, equilaterally spaced about a vertical plane of symmetry of the track.

14. An amusement ride as set forth in claim 7, wherein the guy wires are connected to the second tower means at a greater lateral distance than the lateral distance at which the guy wires are connected to the first tower.

* * * * *